US009502764B2

(12) United States Patent
Au

(10) Patent No.: US 9,502,764 B2
(45) Date of Patent: Nov. 22, 2016

(54) AUTONOMOUS ANTENNA TILT COMPENSATION

(71) Applicant: T-Mobile USA, Inc., Bellevue, WA (US)

(72) Inventor: Chad Au, Kirkland, WA (US)

(73) Assignee: T-Mobile USA, Inc., Bellevue, WA (US)

( * ) Notice: Subject to any disclaimer, the term of this patent is extended or adjusted under 35 U.S.C. 154(b) by 219 days.

(21) Appl. No.: 14/296,460

(22) Filed: Jun. 5, 2014

(65) Prior Publication Data

US 2015/0357708 A1 Dec. 10, 2015

(51) Int. Cl.
*H01Q 3/08* (2006.01)

(52) U.S. Cl.
CPC ..... *H01Q 3/08* (2013.01)

(58) Field of Classification Search
CPC ..... H01Q 3/08
USPC ..... 343/753, 756, 757, 761, 766; 342/358, 342/359
See application file for complete search history.

(56) References Cited

U.S. PATENT DOCUMENTS 4,786,912 A * 11/1988 Brown ..... H01Q 1/18 343/757
6,433,736 B1 * 8/2002 Timothy ..... H01Q 1/18 342/359
6,956,526 B1 * 10/2005 Lundstedt, Jr. ..... H01Q 1/1257 342/359
7,956,806 B2 * 6/2011 Liu ..... H04B 7/086 342/359
8,299,962 B2 * 10/2012 Le Sage ..... H01Q 1/125 342/359
9,007,276 B2 * 4/2015 Locatori ..... H01Q 1/18 343/872
2011/0151932 A1 6/2011 Kim
2012/0086603 A1 4/2012 Park et al.
2013/0273870 A1 10/2013 Shi
2013/0328716 A1 12/2013 Le Sage

FOREIGN PATENT DOCUMENTS

JP 2011193085 9/2011

OTHER PUBLICATIONS

The PCT Search Report mailed Aug. 28, 2015 for PCT application No. PCT/US2015/034406, 13 pages.

* cited by examiner

*Primary Examiner* — Tho G Phan
(74) *Attorney, Agent, or Firm* — Lee & Hayes, PLLC

(57) ABSTRACT

Described herein are techniques related to antenna beam positioning. In one implementation, an electrical tilt of an antenna is modified based on a physical orientation of the antenna. The electrical tilt of the antenna may be modified autonomously based on the orientation of the antenna.

15 Claims, 4 Drawing Sheets

AUTONOMOUS ANTENNA TILT COMPENSATION

BACKGROUND

Antennas are commonly installed on structures, such as buildings and towers, at a height above the surface of the earth thereby permitting broadcast communication over a wide area. Some antennas are directional antennas requiring precise installation and orientation for optimal system performance. For example, the type of orientation that affects antenna broadcast communications include azimuth, elevation tilt, and slant. Therefore, depending upon the quantity and orientation of an array of antennas, each antenna will have an independent orientation in order to provide optimal performance.

Telecommunication antennas are typically directional antennas housed within an elongated enclosure. Previously, telecommunication antenna orientation was accomplished manually by conducting a rough approximation from ground level, e.g., by surveyors, followed by an antenna-level fine adjustment consisting of reorientation of the antenna enclosure by skilled technicians using special equipment and techniques. Such manual antenna orientation and adjustment procedures had a number of disadvantages. For example, they tended to be relatively expensive because the technicians were relatively highly-trained, and the equipment was relatively sophisticated. Moreover, determining antenna orientation at any given point in time required technicians to ascend a structure, individually assess antenna orientation and adjust the antenna position, one-by-one, using iterative procedures, which tended to be time-consuming, particularly for installations consisting of a number of antennas.

Another approach to manual telecommunication antenna orientation and adjustment uses the global navigation satellite system (GNSS, including GPS) receiver dishes mounted on frames, which in turn are temporarily mounted on the antennas for conducting azimuth, elevation tilt and slant orientation and adjustment of the antenna. Multiple GPS receiver dishes in a predetermined spaced relation can be used for computing orientation of an antenna by triangulating the GPS signals, or a single GPS receiver dish can be moved from one location to another. However, the GPS receiver dishes and the frames on which they are mounted must be relocated for each separate antenna orientation and adjustment. Subsequent antenna adjustments require technicians to ascend the transmission structure to reattach the GPS equipment to the individual antenna enclosures in order to obtain orientation readings in real-time, followed by manual reorientation of the antenna by adjusting the mountings accordingly. Some of the structures are designed to support just the weight of the antennas and not the technician, which results in sagging of the structure during alignment procedures. The result is misaligned antennas once the technician comes down from the structure. Therefore, regardless of the alignment method, such structural deficiencies nullify the antenna orientation effort.

The aforementioned and other previous antenna orientation and adjustment devices and methods are unable to continuously monitor antenna orientation and detect disorientation from a baseline orientation. Cellular telecommunications antennas are susceptible to physical disorientation from various causes, such as meteorological, geological, site construction work, and other impact forces. For example, forces generated during a major storm may change the orientation of antenna housings on telecommunications towers and in other installations within an entire region resulting in communications performance degradation. Consequently, identification of antennas in need of reorientation, and reorientation of each affected antenna would require individualized physical attention from a technician. Therefore, an antenna orientation and adjustment system and method should not only facilitate initial orientation, but also facilitate ongoing orientation monitoring with an ability to detect conditions of disorientation, thereby requiring limited physical visits by technicians to antenna installations, and limited need for specialized equipment in order to effectuate installation and orientation of telecommunications antenna. Moreover, an antenna orientation system and method should be adaptable to existing antenna equipment permitting ease of installation and compliance with stringent regulatory requirements and approval procedures.

SUMMARY

Described herein are techniques related to antenna beam positioning. In one implementation, an electrical tilt of an antenna is modified based on a physical orientation of the antenna. The electrical tilt of the antenna may be modified autonomously based on the orientation of the antenna. In one implementation, a sensor is capable of detecting a deviation of a physical position of the antenna, to include azimuth, slant, pitch angle, roll angle and/or height of the antenna. In response to detecting one or more of such antenna physical position deviations, the described herein technologies may autonomously respond by compensating for such physical position deviations by altering the electrical tilt of the antenna.

This Summary is submitted with the understanding that it will not be used to interpret or limit the scope or meaning of the claims. This Summary is not intended to identify key features or essential features of the claimed subject matter, nor is it intended to be used as an aid in determining the scope of the claimed subject matter.

Figure 1:
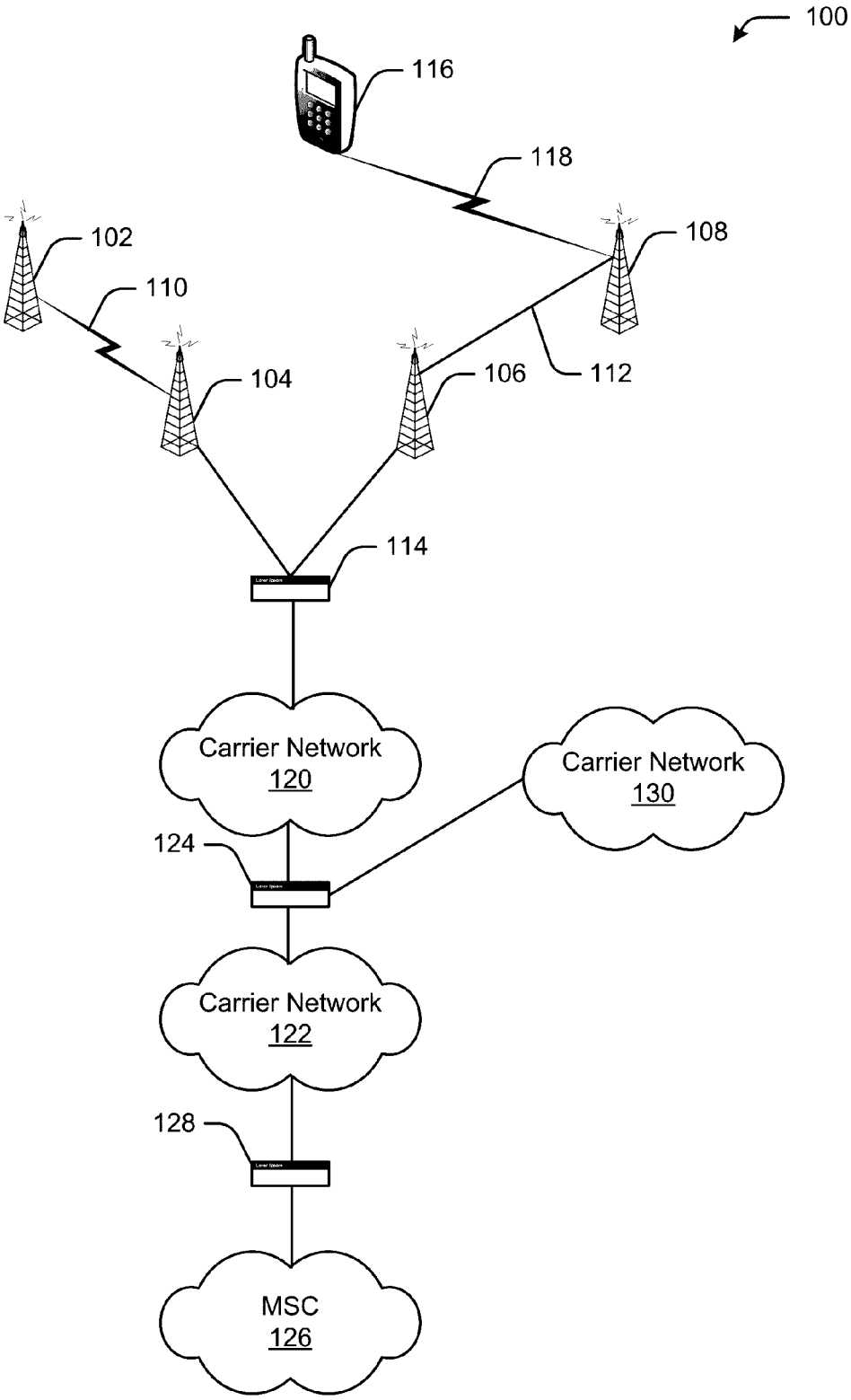
FIG. 1 illustrates an exemplary wireless communication system.

The Detailed Description references the accompanying figures. In the figures, the left-most digit(s) of a reference number identifies the figure in which the reference number first appears. The same numbers are used throughout the drawings to reference like features and components. Also, note that any text smaller than ten point is presented merely to indict where text would appear in the depicted figures. Since such text is merely an indicator of where text might appear, the content of such text is unimportant to the understanding the implementations depicted.

DETAILED DESCRIPTION

Described herein are techniques related to antenna beam positioning. In one implementation, an electrical tilt of an antenna is modified based on a physical orientation of the antenna. The electrical tilt of the antenna may be modified autonomously based on the orientation of the antenna. In one implementation, a sensor is capable of detecting a deviation of a physical position of the antenna, to include azimuth, slant, pitch angle, roll angle and/or height of the antenna. In response to detecting one or more of such antenna physical position deviations, the described herein technologies may autonomously respond by compensating for such physical position deviations by altering the electrical tilt of the antenna.

Wireless communication device, mobile communication device, base station or user device, as used herein and throughout this disclosure, refers to any electronic device capable of wirelessly sending and receiving data. Such devices may have a processor, a memory, a transceiver, an input, and an output. Examples of such devices include cellular telephones, personal digital assistants (PDAs), portable computers, etc. The memory stores applications, software, or logic. Examples of processors are computer processors (processing units), microprocessors, digital signal processors, controllers and microcontrollers, etc. Examples of device memories that may comprise logic include RAM (random access memory), flash memories, ROMS (read-only memories), EPROMS (erasable programmable read-only memories), and EEPROMS (electrically erasable programmable read-only memories).

Mobile devices may communicate with each other and with other elements via a network, for instance, a wireless network, or a wireline network. A network may include broadband wide-area networks such as cellular networks including base stations and other associated communication elements, local-area networks (LAN), Wi-Fi, and personal area networks, such as NFC networks including Bluetooth®. Communication across a network may be packet-based; however, radio and frequency/amplitude modulation networks may enable communication between communication devices using appropriate analog-digital-analog converters and other elements. Communication may be enabled by hardware or mixed hardware and software elements called transceivers. Mobile devices may have more than one transceiver, capable of communicating over different networks. For example, a cellular telephone may include a cellular transceiver for communicating with a cellular base station, a Wi-Fi transceiver for communicating with a Wi-Fi network, and a Bluetooth® transceiver for communicating with a Bluetooth® device. A Wi-Fi network is accessible via access points such as wireless routers, etc., that communicate with the Wi-Fi transceiver to send and receive data. The Wi-Fi network may further be connected to the internet or other packet-based networks. The bandwidth of a network connection or an access point is a measure of the rate of data transfer, and can be expressed as a quantity of data transferred per unit of time.

A network typically includes a plurality of elements that host logic or intelligence for performing tasks on the network. The logic can be hosted on servers. In modern packet-based wide-area networks, servers may be placed at several logical points on the network. Servers may further be in communication with databases and can enable communication devices to access the contents of a database. Billing servers, application servers, etc. are examples of such servers. A server may include several network elements, including other servers, and can be logically situation anywhere on a service provider's network, such as the back-end of a cellular network FIG. 1 illustrates an exemplary wireless communication system 100. The wireless system 100 may employ multiple base stations 102, 104, 106 and 108. The base station 102 is shown as being coupled to the base station 104 by way of a wireless communication link 110. The base station 108 is shown as being coupled to the base station 106 using a wire or optical link 112. Each of the base stations 104 and 106 is shown as being coupled to a router 114. The link between the router 114 and the base stations 104 and 106 may be wire or wireless link implemented. A wireless device 116, such as a mobile phone, may be coupled to the base station 108 via wireless signals 118. The illustrated base stations 102, 104, 106 and 108 have associated antenna componentry. The associated antenna componentry will be described in greater detail in the following disclosure.

A plurality of carrier networks 120 and 122 may be used in the wireless communication system 100. A router 124 may couple the two carrier networks 120 and 122. A mobile switching center (MSC) 126 may be coupled to the carrier network 122 through a router 128. Generally, wired links are used between the router 114 and the MSC 126. However, wireless connectivity may also be used. To enable further expansion of the wireless communication system 100, a further carrier network 130 may be implemented and which is shown as being coupled to the router 124. A plurality of routers (e.g., edge and internal routers) may be implemented within the 'clouds' illustrating the carrier networks 120, 122 and 130.

In a generic wireless communication system, there may be only a single carrier network that is to route traffic from the MSC to the base stations coupled to the carrier network. In such an arrangement, each base station is regarded as individual access point (AP), which is one wired hop through a router to access the carrier network. In other words, the end-to-end transport connection includes the MSC that receives and sends traffic from the carrier network to a base station (i.e., 1:1:1 traffic routing).

Figure 2:
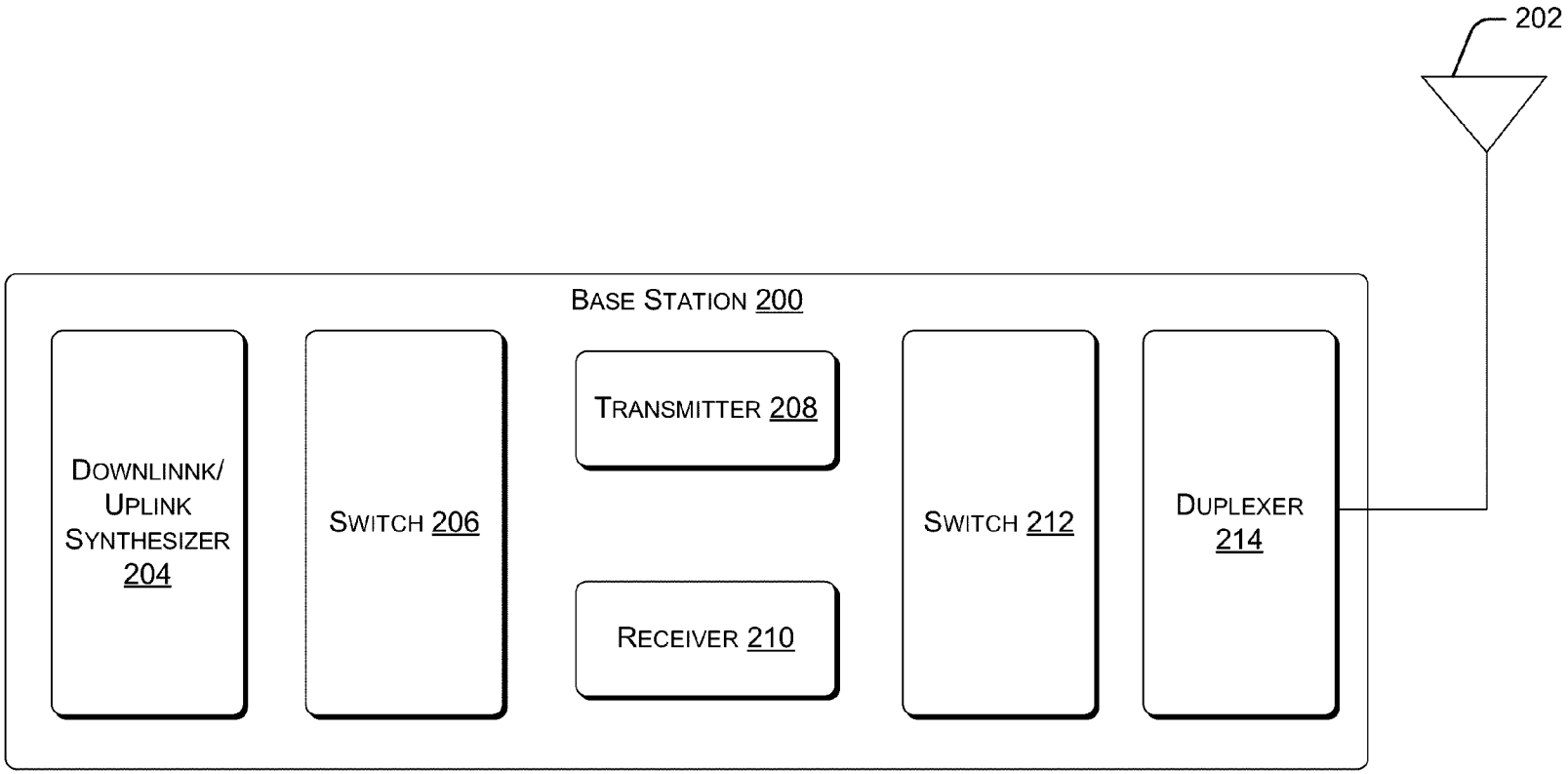
FIG. 2 illustrates a base station which is enabled to transmit and receive data and voice signals.

FIG. 2 illustrates a base station 200 which is enabled to transmit and receive data and voice signals. The base station 200 includes an antenna 202 for receiving and transmitting data and/or voice signals. The base station 200 also includes a downlink synthesizer and an uplink synthesizer 204, the downlink synthesizer being tuned to a downlink frequency and the uplink synthesizer being tuned to an uplink frequency A synthesizer switch 206 is provided enabling the downlink synthesizer to be connected to either the transmitter circuit 208 or the receiver circuit 210 and the uplink synthesizer to be connected to the transmitter circuit 208 or the receiver circuit 210. Thus, the base station 4 can both transmit and receive in either the band of frequencies conventionally assigned to data uplink or the band of frequencies conventionally assigned for data downlink. The transmitter circuit 208 and receiver circuit 210 may each be transceivers.

Further, there is provided a transceiver switch 212 which enables the transmitter 208 to be connected to either the uplink or the downlink port (not shown) of a duplexer 214 in the base station 200 and the receiver 210 to be connected to either the uplink or the downlink port of the duplexer 214.

The duplexer 214 is configured to pass data received at the uplink port to the antenna 202 for transmission in the uplink frequency band, and pass data received at the antenna 202 in the uplink frequency band to the uplink port. Additionally, the duplexer 214 is also configured to pass data to the antenna 202 for transmission in the downlink frequency band and pass data, received at the antenna 202 in the downlink frequency band to the downlink port. By selectively connecting the transmitter circuit 208 or the receiver circuit 210 to the relevant port the transceiver switch 212 allows the base station 200 to receive data or transmit data in either uplink or downlink frequency band.

Figure 3:
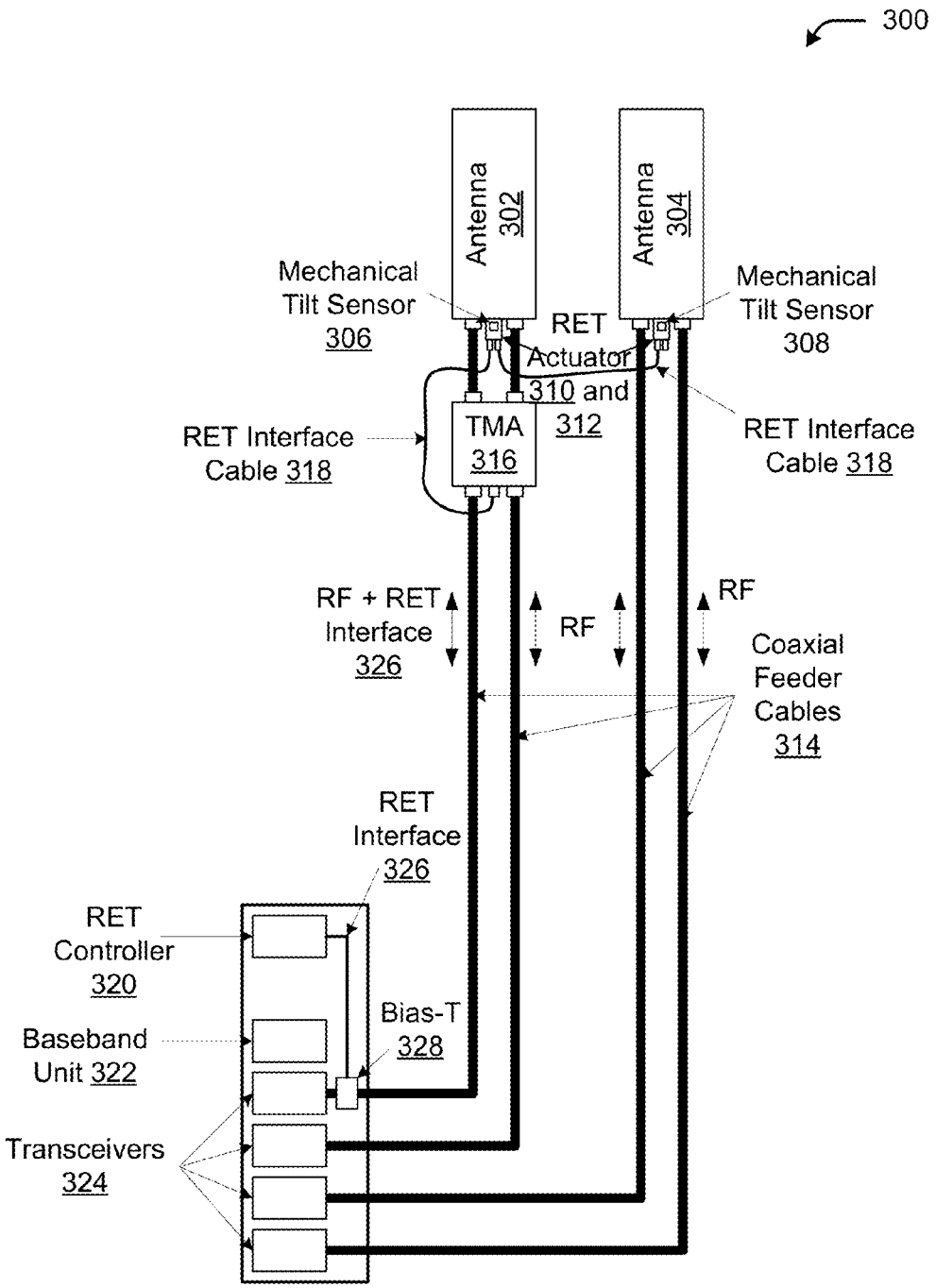
FIG. 3 illustrates an base station having associated therewith the ability of detecting a mechanical tilt associated with at least one antenna and functionality to respond to the detected mechanical tilt by adjusting an electrical tilt of the at least one antenna.

FIG. 3 illustrates an base station 300 having associated therewith the ability of detecting a mechanical tilt or offset associated with at least one antenna and functionality to respond to the detected mechanical tilt by adjusting an electrical tilt of the at least one antenna. As is illustrated in the figure, the base station 300 includes antennas 302 and 304. The base station 300 may alternatively have a single antenna or a plurality of antennas greater than two.

The base station 300 also includes a mechanical tilt sensor 306, or a plurality of sensors, coupled to the antenna 302. The mechanical tilt sensor or sensors 306 may also be referred to herein as an antenna orientation sensor. Furthermore, a mechanical tilt sensor 308, or a plurality of sensors, also referred to as an antenna orientation sensor, is coupled to the antenna 304. The mechanical tilt sensors 306 and 308 are functional to determine a deviation of a physical position of the antenna, to include azimuth, slant, pitch angle, roll angle and/or height associated with the antennas 302 and 304. Each of the mechanical tilt sensors 306 and 308 may include an inclinometer, an axis accelerometer and/or an axis inclinometer/accelerometer. In general, each of the mechanical tilt sensors 306 and 308 may be electrical or electrical mechanical devices capable of detecting a shift or change in physical orientation of the antennas 302 and 304. Furthermore, a plurality of sensors may be used in order to detect a deviation of a physical position of the antenna, where one or more sensor detects the deviation in azimuth, one or more sensor exit deviation and slant, one or more sensor detects a deviation and pitch angle, one or more sensor detects a deviation in roll angle, and one or more sensor detects a deviation in height.

The mechanical tilt sensor 306 may be associated with a remote electrical tilt (RET) controller 310. Furthermore, the mechanical tilt sensor 308 may be associated with a RET controller 312. In one example, the RET controllers or actuators 310 and 312 are integral with the mechanical tilt sensors 306 and 308, respectively. In another example, the RET controllers 310 and 312 are standalone devices, or otherwise external to the mechanical tilt sensors 306 and 308. The RET controller 310 may be coupled to a phase shifter or a plurality of phase shifters associated with the antenna 302. The RET controller 310 is functional to drive the phase shifter of the antenna 302 in order to modify or otherwise control an electrical tilt of the antenna 302. The RET controller 312 may be coupled to a phase shifter or a plurality of phase shifters associated with the antenna 304. The RET controller 312 is functional to drive the phase shifter of the antenna 304 in order to modify or otherwise control an electrical tilt of the antenna 304. In one embodiment, the RET controller 310 drives the phase shifter of the antenna 302 to modify the electrical tilt thereof in response to a tilt deviation or other physical change of the antenna 302 detected by the mechanical tilt sensor 306. Similarly, in one embodiment, the RET controller 312 drives the phase shifter of the antenna 304 to modify the electrical tilt thereof in response to a tilt deviation or other physical change of the antenna 304 detected by the mechanical tilt sensor 308. Adjusting the electrical tilt of the antennas 302 and 304 may be accomplished autonomously by the RET controllers 310 and 312 in accordance with control signals received thereby.

The base station 300 may include a plurality of coaxial feeder cables 314 that carry radio frequency (RF) signals as well as other signals, such as data signals and/or controller signals that may be received by the RET controller 310 and 312. Furthermore, the base station 300 may include a tower mounted amplifier (TMA) 316 that at the minimum receives and processes control signals that are for communication to and from the RET controllers 310 and 312. The TMA 316 may couple an interface cable 318 individually to each of the RET controllers 310 and 312. Alternatively, as is illustrated in FIG. 3, the RET controllers 310 and 312 may be coupled to the TMA 316 in a daisy-chain manner.

The base station 300 may further include a RET controller 320, a baseband unit 322 and a plurality of transceivers 324. In the example shown in FIG. 3, the RET controller 320 is coupled to one of the coaxial feeder cables 314 via a RET interface cable 326 and a bias-t diplexer 328. However, it should be understood that the RET controller 320 may be located anywhere in the base station 300. For example, the RET controller 320 may be associated with the TMA 316, the mechanical tilt sensors 306 or 308, or even the antennas 302 or 304.

The autonomous electrical tilt functionality associated with the base station 300 will now be described. The mechanical tilt sensor 306, or a plurality of sensors, is functional to detect a deviation of a physical position of the antenna 302, to include azimuth, slant, pitch angle, roll angle and/or height associated with associated with the antenna 302. A tilt or slant deviation or other physical change detected by the mechanical tilt sensor 306 may be communicated to the RET controller 320. The RET controller 320 may respond to the tilt or slant deviation detected by the mechanical tilt sensor 306 by communicating a signal to the RET controller 310 that causes the RET controller 310 to modify the electrical tilt associated with antenna 302. In one example, the electrical tilt associated with the antenna 302 is adjusted by way of one or more phase shifters associated with the antenna 302.

In one implementation, the signal communicated to the RET controller 310 is generated automatically by the RET controller 320 in response to the tilt or slant deviation detected by the mechanical tilt sensor 306. This automatic generation of the signal may be accomplished by having the RET controller 320 compare the amount of tilt or slant deviation detected by the mechanical tilt sensor 306 to a maximum allowable deviation value or values stored in a memory or storage unit of the RET controller 320. A determination by the RET controller 320 that the detected amount of tilt or slant deviation exceeds the maximum allowable deviation value will cause the RET controller 320 autonomously instruct the RET controller 310 to adjust the electrical tilt of the antenna 302.

Similar to the foregoing, a deviation of a physical position of the antenna 304, to include azimuth, slant, pitch angle, roll angle and/or height associated with the antenna 304 may be detected by the mechanical tilt sensor 308, or plurality of sensors, and communicated to the RET controller 320. The RET controller 320 may respond to the tilt or slant deviation or other physical change detected by the mechanical tilt sensor 308 by communicating a signal to the RET controller 312 that causes the RET controller 312 to modify the electrical tilt associated with antenna 304. In one example, the electrical tilt associated with the antenna 304 is adjusted by way of one or more phase shifters associated with the antenna 304.

In one implementation, the signal communicated to the RET controller 312 is generated automatically by the RET controller 320 in response to the tilt or slant deviation detected by the mechanical tilt sensor 308. This automatic generation of the signal may be accomplished by having the RET controller 320 compare the amount of tilt or slant deviation detected by the mechanical tilt sensor 308 to a maximum allowable deviation value or values stored in a memory or storage unit of the RET controller 320. A determination by the RET controller 320 that the detected amount of tilt or slant deviation exceeds the maximum allowable tilt deviation value will cause the RET controller 320 autonomously instruct the RET controller 312 to adjust the electrical tilt of the antenna 304.

Figure 4:
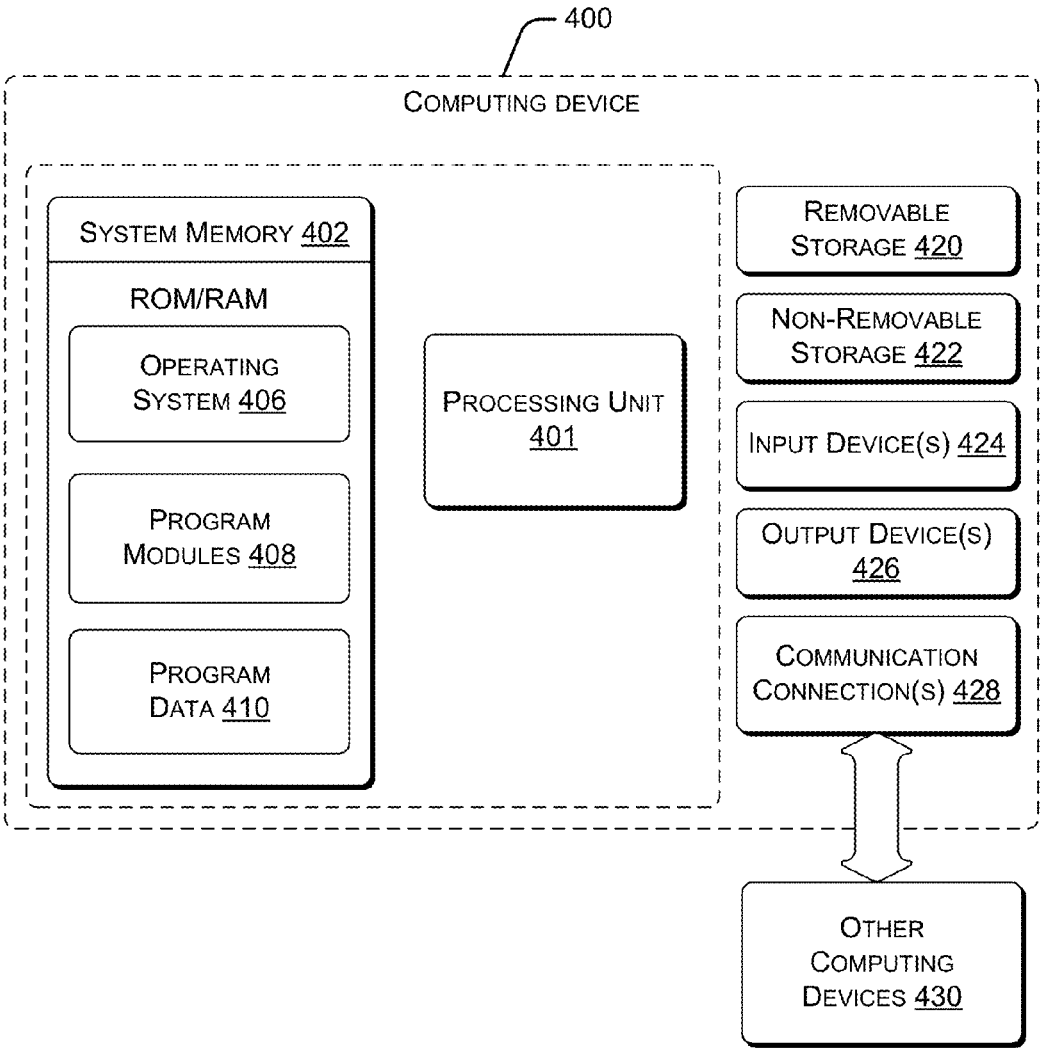
FIG. 4 is an illustrative computing device that may be used to implement exemplary implementations described herein.

FIG. 4 is an illustrative computing device 400 that may be used to implement exemplary implementations described herein. In particular, the computing device 400 may be used to implement one or more of the elements illustrated in FIGS. 1-3. In a very basic configuration, the computing device 400 includes at least one processing unit 401 and a system memory 402. Depending on the exact configuration and type of the computing device 400, the system memory 402 may be volatile (such as RAM), non-volatile (such as ROM, flash memory, etc.) or some combination of the two. The system memory 402 typically includes an operating system 406, one or more program modules or applications 408, and may include program data 410 in the form of, in one implementation, executable instructions.

The computing device 400 may have additional features or functionality. For example, the computing device 400 may also include additional data storage devices (removable and/or non-removable) such as, for example, magnetic disks, optical disks, or tape. Such additional storage is illustrated in FIG. 400 as a removable storage 420 and a non-removable storage 422. Computer storage media may include volatile and nonvolatile, removable and non-removable media implemented in any method or technology for storage of information, such as computer readable instructions, data structures, program modules, or other data. The system memory 402, removable storage 420 and the non-removable storage 422 are all examples of computer storage media. Thus, computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by the computing device 400. Any such computer storage media may be part of the device 400. The computing device 400 may also have an input device(s) 424 such as keyboard, mouse, pen, voice input device, touch input device, etc. An output device(s) 426 such as a display, speakers, printer, etc. may also be included. These devices are well known in the art and need not be discussed at length.

The computing device 400 may also contain a communication connection 428 that allows the device to communicate with other computing devices 430, such as over a wireless or wireline network (e.g. the Internet). The communication connection(s) 428 is one example of communication media. Communication media may typically be embodied by computer readable instructions, data structures, program modules, or other data in a modulated data signal, such as a carrier wave or other transport mechanism, and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Computer readable media can be any available media that can be accessed by a computer. By way of example, and not limitation, computer readable media may comprise "computer storage media" and "communications media."

In the above description of exemplary implementations, for purposes of explanation, specific numbers, materials configurations, and other details are set forth in order to better explain the invention, as claimed. However, it will be apparent to one skilled in the art that the claimed invention may be practiced using different details than the exemplary ones described herein. In other instances, well-known features are omitted or simplified to clarify the description of the exemplary implementations.

The inventors intend the described exemplary implementations to be primarily examples. The inventors do not intend these exemplary implementations to limit the scope of the appended claims. Rather, the inventors have contemplated that the claimed invention might also be embodied and implemented in other ways, in conjunction with other present or future technologies.

Moreover, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts and techniques in a concrete fashion. The term "techniques," for instance, may refer to one or more devices, apparatuses, systems, methods, articles of manufacture, and/or computer-readable instructions as indicated by the context described herein.

As used in this application, the term "or" is intended to mean an inclusive "or" rather than an exclusive "or." That is, unless specified otherwise or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more," unless specified otherwise or clear from context to be directed to a singular form.

The exemplary processes discussed herein are illustrated as a collection of blocks in a logical flow graph, which represents a sequence of operations that can be implemented with hardware, software, firmware, or some combination thereof. In the context of software/firmware, the blocks represent instructions stored on one or more processor-readable storage media that, when executed by one or more processors, perform the recited operations. The operations of the exemplary processes may be rendered in virtually any programming language or environment including (by way of example and not limitation): C/C++, Fortran, COBOL, PASCAL, assembly language, markup languages (e.g., HTML, SGML, XML, VoXML), and the like, as well as object-oriented environments such as the Common Object Request Broker Architecture (CORBA), Java™ (including J2ME, Java Beans, etc.), Binary Runtime Environment (BREW), and the like.

Note that the order in which the processes are described is not intended to be construed as a limitation, and any number of the described process blocks can be combined in any order to implement the processes or an alternate process. Additionally, individual blocks may be deleted from the processes without departing from the spirit and scope of the subject matter described herein.

The term "processor-readable media" includes processor-storage media. For example, processor-storage media may include, but are not limited to, magnetic storage devices (e.g., hard disk, floppy disk, and magnetic strips), optical disks (e.g., compact disk (CD) and digital versatile disk (DVD)), smart cards, flash memory devices (e.g., thumb drive, stick, key drive, and SD cards), and volatile and non-volatile memory (e.g., random access memory (RAM), read-only memory (ROM)).

For the purposes of this disclosure and the claims that follow, the terms "coupled" and "connected" may have been used to describe how various elements interface. Such described interfacing of various elements may be either direct or indirect.

What is claimed is:

1. A base station, comprising:

an antenna configured to produce a beam and mounted for physical adjustable orientation;

an antenna orientation sensor coupled to the antenna and configured to provide a signal characterizing a physical orientation of the antenna;

a first remote electrical tilt (RET) controller configured to receive the signal characterizing the physical orientation of the antenna and to provide an electrical tilt controlling signal;

a cable coupled to the first RET controller and configured to transmit at least the electrical tilt controlling signal; and a second RET controller physically coupled to the cable and the antenna, the second RET controller configured to receive the electrical tilt controlling signal and autonomously adjust an electrical tilt of the antenna based on the electrical tilt controlling signal.

2. The base station according to claim 1, wherein the signal characterizing the physical orientation of the antenna includes at least a tilt value associated with the antenna.

3. The base station according to claim 1, wherein the first RET controller is configured to provide the electrical tilt controlling signal when the signal characterizing the physical orientation of the antenna indicates that the physical orientation of antenna exceeds a predetermined tilt value.

4. The base station according to claim 1, wherein the second RET controller is coupled to the antenna orientation sensor.

5. The base station according to claim 1, wherein the second RET controller includes a phase shifter that is configured to change an electrical tilt angle associated with the antenna.

6. A method, comprising:

detecting a physical misalignment of an antenna; and autonomously responding to the physical misalignment of the antenna by adjusting an electrical tilt of the antenna, wherein adjusting the electrical tilt comprises diagonally adjusting the tilt by a single phase shifter of a remote electrical tilt (RET) controller coupled to the antenna.

7. The method according to claim 6, wherein the detecting of the physical misalignment of the antenna is provided by an antenna orientation sensor coupled to the antenna.

8. The method according to claim 6, wherein the autonomously responding to the physical misalignment of the antenna is provided by at least a controller associated with the base station and an electrical tilt module coupled to the antenna, the electrical tilt module configured to utilize the RET controller to autonomously adjust an electrical tilt of the antenna based on a signal received from the controller.

9. The method according to claim 8, further comprising generating the signal in response to the detecting of the physical misalignment of the antenna.

10. A method, comprising receiving a signal indicating an antenna has undergone an alignment deviation; and autonomously responding to the signal indicating the antenna has undergone the alignment deviation by adjusting an electrical tilt of the antenna, wherein adjusting the electrical tilt comprises diagonally adjusting the tilt by a single phase shifter of a remote electrical tilt (RET) controller coupled to the antenna.

11. The method according to claim 10, wherein the signal indicating the antenna has undergone the alignment deviation includes azimuth, slant, pitch angle, roll angle and/or height information associated with the antenna.

12. The method according to claim 10, further comprising comparing at least one value associated with the signal indicating the antenna has undergone the alignment deviation to a predetermined value.

13. The method according to claim 12, wherein the autonomously responding act is performed upon determining the at least one value exceeds the predetermined value.

14. The method according to claim 10, further comprising generating an electronic tilt signal in response to the signal indicating the antenna has undergone the alignment deviation; and communicating the electronic tilt signal to the RET controller to adjust the electrical tilt of the antenna.

15. The method according to claim 10, further comprising generating the signal indicating the antenna has undergone the alignment deviation in response to an antenna orientation sensor associated with the antenna determining that the antenna has undergone a physical change in position.

* * * * *